US009784035B2

(12) United States Patent
Boone et al.

(10) Patent No.: US 9,784,035 B2
(45) Date of Patent: Oct. 10, 2017

(54) DRILL PIPE OSCILLATION REGIME AND TORQUE CONTROLLER FOR SLIDE DRILLING

(71) Applicant: Canrig Drilling Technology Ltd., Houston, TX (US)

(72) Inventors: Scott G. Boone, Houston, TX (US); Colin J. Gillan, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 269 days.

(21) Appl. No.: 14/624,086

(22) Filed: Feb. 17, 2015

(65) Prior Publication Data

US 2016/0237802 A1 Aug. 18, 2016

(51) Int. Cl.

| | |
|---|---|
| ***E21B 7/06*** | (2006.01) |
| ***E21B 44/00*** | (2006.01) |
| ***E21B 7/04*** | (2006.01) |

(52) U.S. Cl.

CPC ..... *E21B 7/06* (2013.01); *E21B 7/04* (2013.01); *E21B 44/00* (2013.01)

(58) Field of Classification Search

CPC ..... E21B 7/06; E21B 7/04; E21B 44/00

See application file for complete search history.

(56) References Cited

U.S. PATENT DOCUMENTS

| | | | |
|---|---|---|---|
| 1,891,329 | A | 12/1932 | Le Compte et al. |
| 2,005,889 | A | 6/1935 | Dillon et al. |
| 2,724,574 | A | 11/1955 | Ledgerwood, Jr. |
| 3,223,183 | A | 12/1965 | Varney |
| 3,265,359 | A | 8/1966 | Bowden |

(Continued)

FOREIGN PATENT DOCUMENTS

| | | | |
|---|---|---|---|
| EP | 0774563 | B1 | 7/2002 |
| SU | 1668652 | A1 | 7/1991 |

(Continued)

OTHER PUBLICATIONS

"40223705—Series Wildcat Services Pneumatic Automated Drilling System," available at http://www.nov.com/Drilling/Control_and_Advisiory_Systems/Drawworks_Control_Auto_Drilling/Auto_Drillers.aspx (last visited Oct. 8, 2009).

(Continued)

*Primary Examiner* — Brad Harcourt

(74) *Attorney, Agent, or Firm* — Haynes and Boone, LLP

(57) ABSTRACT

Apparatuses, methods, and systems are described which assist in controlling toolface orientation of a bottom hole assembly. A controller instructs a top drive to oscillate a drill string an oscillation revolution amount to reduce friction of the drill string in a wellbore during a slide drilling procedure. A torque sensor detects torque at an interface between the drill string and the top drive, and the controller determines properties of a torsional wave from the detected torque that is propagating along the drill string during the slide drilling procedure. The controller determines a modification to the oscillation revolution amount and/or rotations per minute in order to control the toolface orientation in a desired manner. The top drive implements the determined modification and thereby assists in controlling the toolface orientation during the slide drilling procedure.

20 Claims, 6 Drawing Sheets

(56) References Cited

U.S. PATENT DOCUMENTS

| | | | |
|---|---|---|---|
| 3,407,886 | A | 10/1968 | Bennett |
| 3,550,697 | A | 12/1970 | Hobhouse |
| 4,384,625 | A | 5/1983 | Roper et al. |
| 4,492,276 | A | 1/1985 | Kamp |
| 4,535,972 | A | 8/1985 | Millheim et al. |
| 4,662,608 | A | 5/1987 | Ball |
| 4,854,397 | A | 8/1989 | Warren et al. |
| 4,958,125 | A | 9/1990 | Jardine et al. |
| 5,103,919 | A | 4/1992 | Warren et al. |
| 5,103,920 | A | 4/1992 | Patton |
| 5,205,163 | A | 4/1993 | Sananikone |
| 5,358,059 | A | 10/1994 | Ho |
| 5,390,748 | A | 2/1995 | Goldman |
| 5,467,832 | A | 11/1995 | Orban et al. |
| 5,474,142 | A | 12/1995 | Bowden |
| 5,551,286 | A | 9/1996 | Booer |
| 5,713,422 | A | 2/1998 | Dhindsa |
| 5,730,234 | A | 3/1998 | Putot |
| 5,738,178 | A | 4/1998 | Williams et al. |
| 5,842,149 | A | 11/1998 | Harrell et al. |
| 6,026,912 | A | 2/2000 | King et al. |
| 6,029,951 | A | 2/2000 | Guggari |
| 6,050,348 | A | 4/2000 | Richarson et al. |
| 6,065,332 | A | 5/2000 | Dominick |
| 6,092,610 | A | 7/2000 | Kosmala et al. |
| 6,152,246 | A | 11/2000 | King et al. |
| 6,155,357 | A | 12/2000 | King et al. |
| 6,192,998 | B1 | 2/2001 | Pinckard |
| 6,233,498 | B1 | 5/2001 | King et al. |
| 6,293,356 | B1 | 9/2001 | King et al. |
| 6,382,331 | B1 | 5/2002 | Pinckard |
| 6,405,808 | B1 | 6/2002 | Edwards et al. |
| 6,523,623 | B1 | 2/2003 | Schuh |
| 6,757,613 | B2 | 6/2004 | Chapman et al. |
| 6,802,378 | B2 | 10/2004 | Haci et al. |
| 6,820,702 | B2 | 11/2004 | Niedermayr et al. |
| 6,892,812 | B2 | 5/2005 | Niedermayr et al. |
| 7,000,710 | B1 | 2/2006 | Umbach |
| 7,032,689 | B2 | 4/2006 | Goldman et al. |
| 7,044,239 | B2 | 5/2006 | Pinckard et al. |
| 7,059,427 | B2 | 6/2006 | Power et al. |
| 7,085,696 | B2 | 8/2006 | King |
| 7,096,979 | B2 | 8/2006 | Haci et al. |
| 7,243,735 | B2 | 7/2007 | Koederitz et al. |
| 7,357,196 | B2 | 4/2008 | Goldman et al. |
| 7,404,454 | B2 | 7/2008 | Hulick |
| 7,546,209 | B2 | 6/2009 | Williams |
| 7,584,788 | B2 | 9/2009 | Baron et al. |
| 7,665,533 | B2 | 2/2010 | Hopwood et al. |
| 7,775,297 | B2 | 8/2010 | Hopwood et al. |
| 7,802,634 | B2 | 9/2010 | Boone |
| 7,823,655 | B2 | 11/2010 | Boone et al. |
| 7,860,593 | B2 | 12/2010 | Boone |
| 7,882,902 | B2 | 2/2011 | Boutwell, Jr. |
| 7,938,197 | B2 | 5/2011 | Boone et al. |
| 8,215,417 | B2 | 7/2012 | Annaiyappa et al. |
| 8,510,081 | B2 | 8/2013 | Boone |
| 8,528,663 | B2 | 9/2013 | Boone |
| 2002/0104685 | A1 | 8/2002 | Pinckard et al. |
| 2003/0024738 | A1 | 2/2003 | Schuh |
| 2003/0051914 | A1 | 3/2003 | Bittar |
| 2004/0028476 | A1 | 2/2004 | Payne et al. |
| 2006/0185899 | A1 | 8/2006 | Alft et al. |
| 2007/0181343 | A1 | 8/2007 | Russell et al. |
| 2007/0203651 | A1 | 8/2007 | Blanz et al. |
| 2007/0256861 | A1 | 11/2007 | Hulick |
| 2008/0156531 | A1 | 7/2008 | Boone et al. |
| 2008/0173480 | A1 | 7/2008 | Annaiyappa et al. |
| 2008/0281525 | A1 | 11/2008 | Boone |
| 2009/0058674 | A1 | 3/2009 | Papouras et al. |
| 2009/0078462 | A1 | 3/2009 | Boone |
| 2009/0090555 | A1 | 4/2009 | Boone et al. |
| 2009/0152005 | A1 | 6/2009 | Chapman |
| 2009/0159336 | A1 | 6/2009 | Boone |
| 2009/0250264 | A1 | 10/2009 | Dupriest |
| 2010/0121776 | A1 | 5/2010 | Stenger |
| 2010/0217530 | A1 | 8/2010 | Boone |
| 2011/0024187 | A1 | 2/2011 | Boone et al. |
| 2011/0024191 | A1 | 2/2011 | Boone |
| 2012/0228028 | A1 | 9/2012 | Turner et al. |
| 2013/0248248 | A1 | 9/2013 | Steidl et al. |
| 2014/0305702 | A1* | 10/2014 | Bowley ..... E21B 44/04 175/27 |

FOREIGN PATENT DOCUMENTS

| | | |
|---|---|---|
| WO | WO 93/12318 | 6/1993 |
| WO | WO 2004/055325 | 7/2004 |
| WO | WO 2004/109052 A2 | 12/2004 |
| WO | WO 2006/079847 | 8/2006 |
| WO | WO 2007/073430 | 6/2007 |
| WO | WO 2008/070829 | 6/2008 |
| WO | WO 2009/039448 | 3/2009 |
| WO | WO 2009/039453 | 3/2009 |
| WO | WO 2014/147116 A1 | 9/2014 |

OTHER PUBLICATIONS

"Wildcat ADS Automated Drilling System," Product Brochure, National Oilwell Varco, Inc. (2006).

Answer to Plaintiff's Complaint; Case 6:09-cv-00414-LED; Doc 25; Nov. 6, 2009.

Bonner, et al., "Measurements at the Bit: A New Generation of MWD Tools," *Oilfield Review*, pp. 44-54, Apr./Jul. 1993.

Brett, et al., "Field Experiences with Computer-Controlled Drilling," *Society of Petroleum Engineers 20107*, presented at *Permian Basin Oil and Gas Recovery Conference*, Midland, TX (Mar. 8-9, 1990).

Brown, et al., "In-Time Data Delivery," *Oilfield Review*, 11(4): 34-55, http://www.slb.com/media/services/resources/oilfieldreview/ors99/win99/pages34_55.pdf (Winter 1999/2000).

Canrig Drilling Technology Ltd.'s Objections and Responses to Helmerick & Payne's First Set of Interrogatories, Civil Action No. 6:09-cv-00414, Aug. 23, 2010.

Canrig's Answers to Omron Oilfield and Marine, Inc.'s First Set of Interrogatories, Civil Action No. 6:09-cv-00414, May 7, 2010.

Defendant Helmerich & Payne's Invalidity Contentions; Case 6:09-cv-00414-LED; Mar. 25, 2010.

Defendant Omron Oilfield and Marine, Inc's Patent Rule 3-3 Disclosures; Case 6:09-cv-00414-LED; Mar. 25, 2010.

Defendant Omron Oilfield and Marine, Inc's Patent Rule 3-4 Disclosures; Case 6:09-cv-00414-LED; Mar. 25, 2010.

Defendant's Joint Preliminary Claim Construction and Extrinsic Evidence, Civil Action No. 6:09-cv-00414LED, Sep. 24, 2010.

Dupriest, F., et al., "Maximizing Drill Rates with Real-Time Surveillance of Mechanical Specific Energy," SPE/IADC Drilling Conference 92194, Amsterdam, The Netherlands, p. 1-10 (Feb. 23-25, 2005).

Dupriest, F., "Comprehensive Drill-Rate Management Process to Maximize Rate of Penetration," SPE Annual Technology Conference and Exhibition, San Antonio, Texas, SPE 102210, p. 1-9 (Sep. 24-27, 2006).

Dupriest, F., "Maximizing ROP with Real-Time Analysis of Digital Data and MSE," International Petroleum Technology Conference, Doha, Qatar, p. 1-8 (Nov. 21-23, 2005).

Goldman, "Artificial Intelligence Applications Enhance Directional Control," *Petroleum Engineer International*, pp. 15-22, Feb. 1993.

Gurari, E., "CIS 680: Data Structures: Chapter 19: Backtracking Algorithms;" http://www.cse.ohio-state.edu/%7Egurari/course/cis680/cis680Ch19.html (1999).

Hartley, et al., "New Drilling Process Increases Rate of Penetration, Footage Per Day," *Offshore*, 66(1): 1-5 (2006).

Helmerich & Payne, Inc.'s First Amended Answer and Counterclaims to Plaintiff's Original Complaint; Case 6:09-cv-00414-LED; Doc 55; Mar. 25, 2010.

Jackson, et al., "Portable Top Drive Cuts Horizontal Drilling Costs," *World Oil Magazine*, vol. 214 Issue 11, pp. 81-89, Nov. 1993.

(56) References Cited

OTHER PUBLICATIONS

Joint Claim Construction Statement, Civil Action No. 6:09-cv-00414LED, Oct. 25, 2010.
Leine, et al., "Stick-Slip Whirl Interaction in Drillstring Dynamics," *J. of Vibration and Acoustics*, 124: 209-220 (2002).
Maidla, et al., "Understanding Torque: The Key to Slide-Drilling Directional Wells," IADC/SPE Drilling Conference, IADC/SPE 87162 (2004).
Murch, "Application of Top Drive Drilling to Horizontal Wells," Society of Petroleum Engineers—SPE 37100, 1996.
Petroleum Extension Service, "Controlled Directional Drilling," N. Janicek (ed.), Third Edition, pp. 18-33 and 44-45, 1984.
Plaintiff Canrig's Local Patent Rule 4-2 Disclosures, Civil Action No. 6:09-cv-00414, Sep. 24, 2010.
Plaintiff's Original Complaint; Case 6:09-cv-00414; Doc. 1; Sep. 16, 2009.
The International Searching Authority, "Written Opinion of the International Searching Authority," PCT/US2007/86768, mailed Jun. 11, 2008.
The International Searching Authority, "Written Opinion of the International Searching Authority," PCT/US2010/024105, mailed Sep. 14, 2010.
Young, Jr., "Computerized Drilling Control," *Journal of Petroleum Technology*, 21(4): 483-96 (1969).
International Search Report and Written Opinion for Application No. PCT/US2016/018076, mailed May 11, 2016, 19 pages.

* cited by examiner

DRILL PIPE OSCILLATION REGIME AND TORQUE CONTROLLER FOR SLIDE DRILLING

BACKGROUND OF THE DISCLOSURE

Underground drilling involves drilling a bore through a formation deep in the Earth using a drill bit connected to a drill string. Two common drilling methods, often used within the same hole, include rotary drilling and slide drilling. Rotary drilling typically includes rotating the drilling string, including the drill bit at the end of the drill string, and driving it forward through subterranean formations. This rotation often occurs via a top drive or other rotary drive means at the surface, and as such, the entire drill string rotates to drive the bit. This is often used during straight runs, where the objective is to advance the bit in a substantially straight direction through the formation.

During rotary drilling, the rotational force applied at the top drive is often out of phase with the reaction at the bottom-hole assembly (BHA) of the drill string due to an elasticity of the material of the drill string, causing the drill string to yield somewhat under the opposing loads imposed by the rotational force at the top drive and friction/inertia at the end where the bit is located. This causes resonant motion to occur between the top drive and the BHA that is undesirable. Further, as the drill string winds up along its length due to the ends being out of phase, the force stored in the winding may exceed any static friction, causing the drill string near the bit to slip relative to the wellbore sides at a high (and often damaging) speed. Measured torque of the drill string may be used in addition to other techniques to adjust a rotation speed during the rotary drilling to reduce the chance of stick-slip and/or other vibrations.

Directional drilling can be accomplished using slide drilling. Slide drilling is often used to steer the drill bit to effect a turn in the drilling path. For example, slide drilling may employ a drilling motor with a bent housing incorporated into the BHA. During typical slide drilling, the drill string is not rotated and the drill bit is rotated exclusively by the drilling motor. The bent housing steers the drill bit in the desired direction as the drill string slides through the bore, thereby effectuating directional drilling. Alternatively, when no directional change is desired, the steerable system can be operated in a rotating mode in which the drill string is rotated while the drilling motor is running.

To reduce wellbore friction during slide drilling, a top drive may be used to oscillate or rotationally rock the drill string during slide drilling to reduce drag of the drill string in the wellbore. This oscillation can reduce friction (e.g., by converting static friction on sections of the drill string to dynamic friction, which has a lower coefficient) in the borehole.

However, some systems that oscillate the drill string during slide drilling do so without knowledge of the resonant motion (e.g., a torsional wave traveling along the length of the drill string) at the top drive. Without knowledge of the resonant motion, drilling operators may under-utilize the oscillation feature while slide drilling due to concern about inadvertently changing the toolface orientation of the bottom hold assembly. This results in less efficient drilling and/or less bit progression due to greater static friction forces acting on the drill string. In addition, current systems do not use resonant motion to control toolface orientation to either maintain a desired toolface orientation or to change the orientation of toolface orientation to a desired orientation while drilling. The present disclosure addresses one or more of the problems of the prior art.

BRIEF DESCRIPTION OF THE DRAWINGS

The present disclosure is best understood from the following detailed description when read with the accompanying figures. It is emphasized that, in accordance with the standard practice in the industry, various features are not drawn to scale. The dimensions of the various features may be arbitrarily increased or reduced for clarity of discussion.

DETAILED DESCRIPTION

Figure 1:
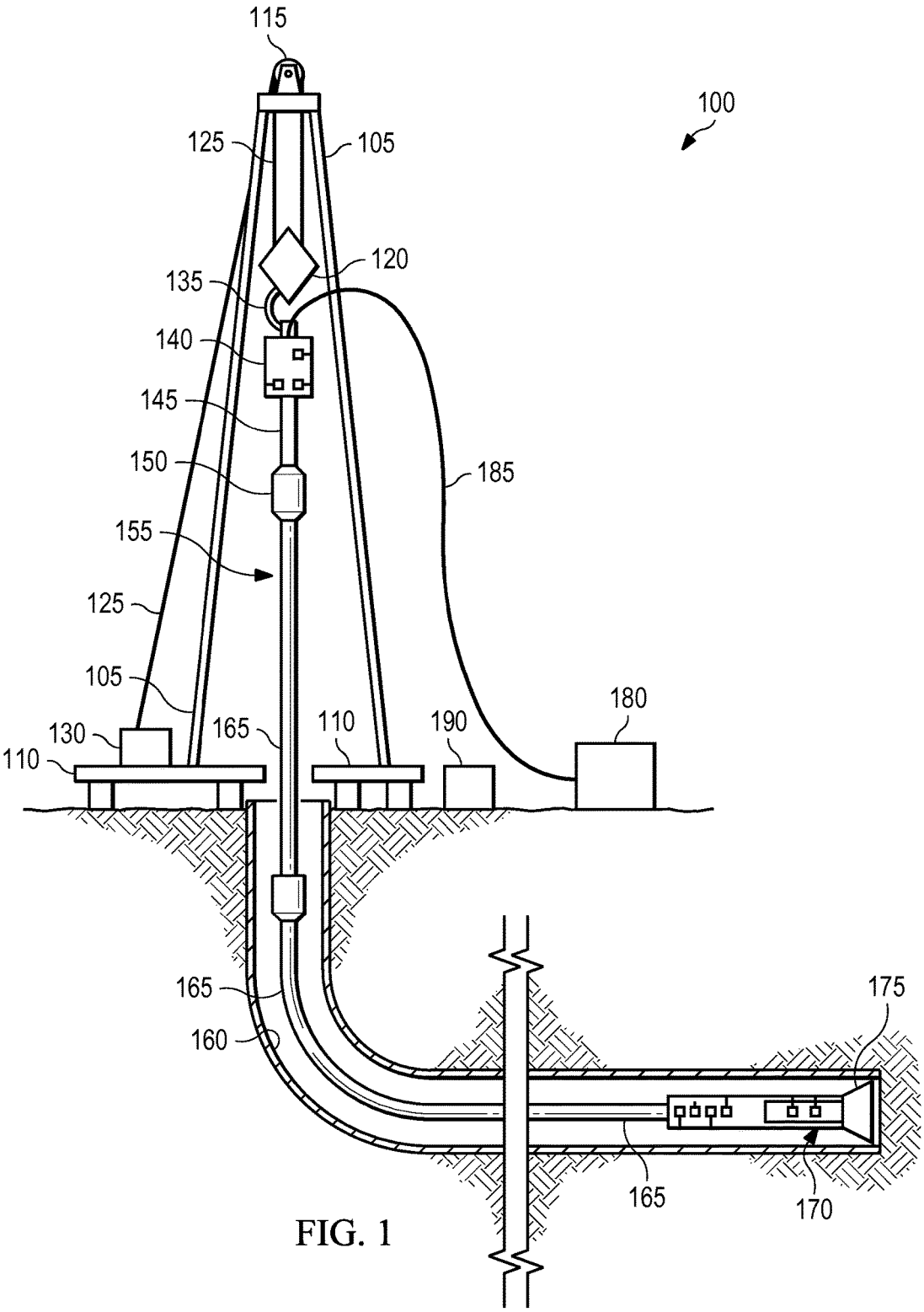
FIG. 1 is a schematic of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

According to aspects of the present disclosure, apparatus, systems, and methods are disclosed for assisting in the control of toolface orientation of a bottom hole assembly in a wellbore during a slide drilling procedure. In an embodiment, the drill string is oscillated during a slide drilling procedure in order to reduce the amount of friction present on the drill string (e.g., where in contact with a side of the wellbore) such as by converting static friction to dynamic friction. As a result of the oscillation (e.g., in both left and right directions from a neutral position), torsional waves are created that propagate along the length of the drill string as there is a differential amount of force on the drill string in different locations, and the drill string itself is composed of a material that has some elasticity, resulting in torsion from the torque applied by the top drive.

In an exemplary embodiment, a sensor detects a torsional wave that is propagating along the drill string in the wellbore. For example, a torque sensor detects torque at an interface between the top drive of the system and the drill string, and the controller receives the detected torque and determines properties of a torsional wave (e.g., magnitude, periodicity, phase, etc.). Based on the magnitude and/or other properties of the torsional wave, the controller determines an adjustment value for one or both of the set oscillation amount and the rotations per minute that will absorb, in part or substantially completely, the torsional wave.

Whether to absorb in part or substantially completely may be determined based on a desired objective. Some potential objectives include maintaining the toolface orientation as oriented while rocking or oscillating a drill string or changing the toolface orientation to a desired orientation while oscillating during a slide drilling procedure. This may be determined based on previously stored information or from an input request from a rig operator, e.g., to change the toolface orientation. After the controller determines whether and/or how much adjustment is needed, it conveys it to the top drive for implementation. As a result, embodiments of the present disclosure provide a relatively high level of control over the toolface orientation during slide drilling operations.

Referring to FIG. 1, illustrated is a schematic view of an apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

The apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to drawworks 130, which is configured to reel out and reel in the drilling line 125 to cause the traveling block 120 to be lowered and raised relative to the rig floor 110. The other end of the drilling line 125, known as a dead line anchor, is anchored to a fixed position, possibly near the drawworks 130 or elsewhere on the rig.

A hook 135 is attached to the bottom of the traveling block 120. A top drive 140 is suspended from the hook 135. A quill 145 extending from the top drive 140 is attached to a saver sub 150, which is attached to a drill string 155 suspended within a wellbore 160. Alternatively, the quill 145 may be attached to the drill string 155 directly. It should be understood that other conventional techniques for arranging a rig do not require a drilling line, and these are included in the scope of this disclosure. In another aspect (not shown), no quill is present.

The drill string 155 includes interconnected sections of drill pipe 165, a bottom hole assembly (BHA) 170, and a drill bit 175. The BHA 170 may include stabilizers, drill collars, and/or measurement-while-drilling (MWD) or wireline conveyed instruments, among other components. The drill bit 175, which may also be referred to herein as a tool, is connected to the bottom of the BHA 170 or is otherwise attached to the drill string 155. One or more pumps 180 may deliver drilling fluid to the drill string 155 through a hose or other conduit 185, which may be fluidically and/or actually connected to the top drive 140.

In the exemplary embodiment depicted in FIG. 1, the top drive 140 is used to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig, among others. According to embodiments of the present disclosure, the top drive 140 may be used to impart a determined oscillation regime target, such as an oscillating revolution target, to reduce wellbore friction on the drill string 155 while controlling a toolface of the drill bit 175 during slide drilling operations.

The apparatus 100 also includes a control system 190 configured to control or assist in the control of one or more components of the apparatus 100. For example, the control system 190 may be configured to transmit operational control signals to the drawworks 130, the top drive 140, the BHA 170 and/or the pump 180. The control system 190 may be a stand-alone component installed near the mast 105 and/or other components of the apparatus 100. In some embodiments, the control system 190 is physically displaced at a location separate and apart from the drilling rig.

According to embodiments of the present disclosure, the control system 190 obtains measurements from one or more sensors or systems, including the torque required to rotate the pipe at or near an interface between the top drive 140 and the drill string 155. The control system 190 utilizes these measurements, along with one or more material properties of the drill string 155 (e.g., as input by a user of the control system 190 or as stored previously in a memory of the control system 190) and one or more material properties of the top drive (e.g., inertia, gear ratio, motor design, stiffness and capacitance of the drive system, and the drive system itself to name a few examples) to determine properties of a torsional wave traveling along the drill string 155 during a slide drilling operation. Many or all of the components between the mast 105 and the BHA 170 may have specific material properties that are considered by the control system 190. With a knowledge of the torsional wave currently at the drill string (e.g., at or near real-time measurement), the control system 190 calculates an adjustment to the number of revolutions specified in the oscillating revolution target, the acceleration, speed of revolutions, or other revolution properties, and instructs the top drive 140 to implement the adjustment. The adjustment may be targeted, for example, on maintaining a toolface orientation of the BHA 170 or on causing the toolface orientation of the BHA 170 to change a specified amount.

Figure 2:
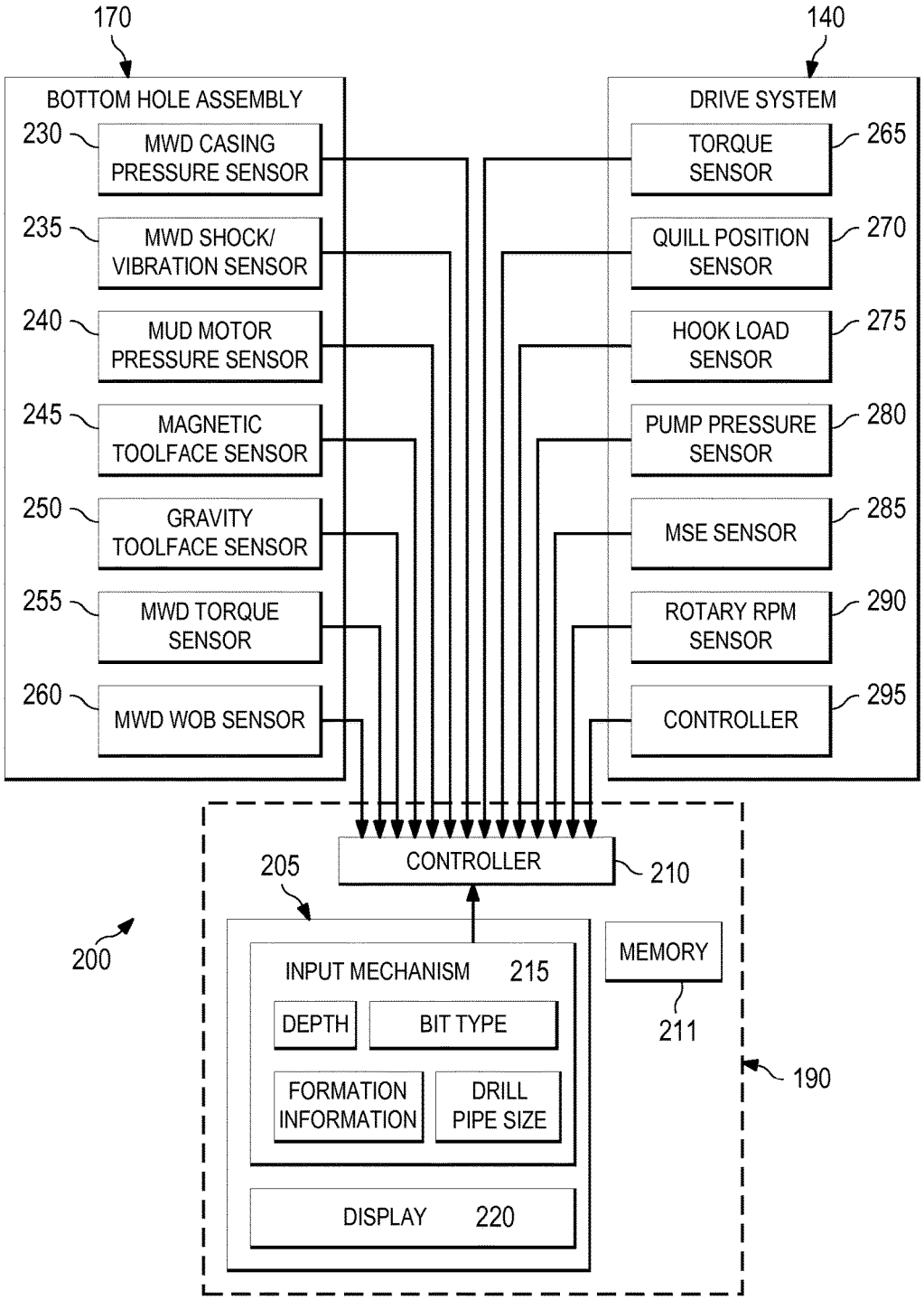
FIG. 2 is a block diagram schematic of an apparatus according to one or more aspects of the present disclosure.

FIG. 2 illustrates a block diagram of a portion of an apparatus 200 according to one or more aspects of the present disclosure. FIG. 2 shows the control system 190, the BHA 170, and the top drive 140, identified as a drive system. The apparatus 200 may be implemented within the environment and/or the apparatus shown in FIG. 1.

The control system 190 includes a user interface 205, a controller 210, and a memory 211. Depending on the embodiment, these may be discrete components that are interconnected via wired or wireless means. Alternatively, the user interface 205, the controller 210, and the memory 211 may be integral components of a single system.

The user interface 205 may include an input mechanism 215 permitting a user to input a variety of information and/or settings. For example, the input mechanism 215 may permit a user to input a left oscillation revolution setting and a right oscillation revolution setting, e.g., for use at the start of a slide drilling operation to reduce friction on the drill string 155 while in the wellbore. These settings control the number of revolutions of the drill string 155 as the control system 190 controls the top drive 140 or other drive system to oscillate the top portion of the drill string 155. The input mechanism 215 may also be used to input additional drilling settings or parameters, such as acceleration, desired toolface orientation, toolface set points, toolface setting limits, rotation settings, and other set points or input data, including predetermined parameters that may determine the limits of oscillation. Further, a user may input information relating to the drilling parameters of the drill string 155, such as BHA 170 information or arrangement, drill pipe size, bit type, depth, formation information, and drill pipe material, among other things. These drilling parameters are useful, for example, in determining a composition of the drill string 155 to better measure and respond to torsional waves detected at the top drive 140.

The input mechanism 215 may include a keypad, voice-recognition apparatus, dial, button, switch, slide selector, toggle, joystick, mouse, data base and/or other conventional or future-developed data input device. Such an input mechanism 215 may support data input from local and/or remote locations. Alternatively, or additionally, the input mechanism 215, when included, may permit user-selection of predetermined profiles, algorithms, set point values or ranges, and drill string 155 information, such as via one or more drop-down menus. The data may also or alternatively be selected by the controller 210 via the execution of one or more database look-up procedures. In general, the input mechanism 215 and/or other components within the scope of the present disclosure support operation and/or monitoring from stations on the rig site as well as one or more remote locations with a communications link to the system, network, local area network (LAN), wide area network (WAN), Internet, satellite-link, and/or radio, among other means.

The user-interface 205 may also include a display 220 for visually presenting information to the user in textual, graphic, or video form. The display 220 may also be utilized by the user to input drilling parameters, limits, or set point data in conjunction with the input mechanism 215. For example, the input mechanism 215 may be integral to or otherwise communicably coupled with the display 220.

The controller 210 may be implemented using a general-purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. The controller 210 may also be implemented as a combination of computing devices, e.g., a combination of a DSP and a microprocessor, a plurality of microprocessors, one or more microprocessors in conjunction with a DSP core, or any other such configuration.

In one example, the controller 210 may include a plurality of pre-stored default selectable oscillation profiles that may be used to control the top drive 140 or other drive system. The pre-stored default selectable profiles may include a right rotational revolution value and a left rotational revolution value. The profile may include, in one example, 5.0 rotations to the right and −3.3 rotations to the left. These values are preferably measured from a central or neutral rotation. The plurality of pre-stored default selectable oscillation profiles may serve as a default basis for rotational revolution values until modified as necessary by the controller 210 based on feedback from the torque sensor 265 at the top drive 140.

The plurality of oscillation profiles may be stored in a memory 211 of the controller 210. The memory 211 may be any electronic component capable of storing information and/or instructions. For example, the memory 250 may include random access memory (RAM), read-only memory (ROM), flash memory devices in RAM, optical storage media, erasable programmable read-only memory (EPROM), registers, solid state memory device, hard disk drives, other forms of volatile and non-volatile memory, or combinations thereof. In an embodiment, the memory 211 includes a non-transitory computer-readable medium. Instructions or code may be stored in the memory 211 that are executable by the controller 210.

For example, the memory 211 may include instructions for performing a process to select the profile and adjust the profile during the slide drilling operation in response to sensed data, such as, for example, torque feedback at the top drive 140. In some embodiments, the profile may include either a right (i.e., clockwise) revolution setting and a left (i.e., counterclockwise) revolution setting. Accordingly, the controller 210 may include instructions and capability to select a pre-established profile including, for example, a right rotation value and a left rotation value, as well as to dynamically adjust the right and left rotation values based on a sensed feedback, such as torque feedback (and resulting torsional wave along the drill string 155) during slide drilling operations. Because some rotational values may be more effective than others in particular drilling scenarios, the controller 210 may be arranged to identify the rotational values that provide a suitable level, and preferably an optimal level, of drilling speed.

The controller 210 may be arranged to receive data or information from the user, the bottom hole assembly 170, and/or the top drive 140 and process the information to select an oscillation profile that might enable effective and efficient slide drilling (e.g., by reducing static friction against the drill string 155 and controlling the toolface orientation by way of controlling torsional waves along the drill string 155). The controller 210 may also store update information to the memory 211, e.g., a desired toolface orientation change obtained from the user as discussed in more detail with respect to FIG. 3 below. This update information may be used to update a given profile stored with the memory 211, or alternatively may be used in combination with a profile to control toolface orientation and reduce friction during slide drilling.

In another embodiment, instead of selecting an oscillation profile, the controller 210 may include instructions and capability to set left and right rotation values at the onset as well as during slide drilling operations without reference to an oscillation profile but instead based on the measured or sensed feedback, such as torque feedback, and calculated torsional wave properties along the drill string 155. As will be recognized, this may instead involve the selection of a default profile for the onset of slide drilling operations, but which is quickly replaced by new rotation values based on dynamic feedback from the torque measurements.

In another embodiment, the controller 210 may include instructions and capability to dynamically select and switch between pre-stored default selectable oscillation profiles. For example, the controller 210 may select a first default oscillation profile at the onset of slide drilling, and as sensed feedback arrives from one or more of the sensors, such as the torque sensor 265, the controller 210 may dynamically select a different pre-set default selectable oscillation profile from among the plurality that can best respond to the existing torsional waves along the drill string 155 to meet the given objective of the controller 210, e.g., to either absorb the torsional waves or to manipulate them to effectuate a desired toolface orientation change. As will be recognized, the above are exemplary only, and the controller 210 may use any one or more of the embodiments to dynamically control the toolface orientation of the BHA 170 based on sensed feedback obtained from any sensor including the torque sensor 265 and computations arising therefrom (e.g., torsional wave magnitude/periodicity/etc.).

The drive system, such as the top drive 140, includes one or more sensors or detectors that provide information that is considered by the controller 210 when it selects the oscillation profile and dynamically adjusts the profile during slide drilling operations to control toolface orientation. The top drive 140 includes a rotary torque sensor 265 that is configured to detect a value or range of the reactive torsion of the quill 145 or drill string 155. The torque sensor 265 may additionally or alternative be configured to detect a value or range of torque output by the top drive 140 (or commanded to be output by the top drive 140), and derive the torque at the drill string 155 based on that measurement. The top drive 140 may also include a quill position sensor 270 that is configured to detect a value or range of the rotational position of the quill, such as relative to true north or another stationary reference. The rotary torque and quill position data detected via sensors 265 and 270, respectively, may be sent via electronic signal or other signal to the controller 210 via wired or wireless transmission.

The top drive 140 may also include a hook load sensor 275, a pump pressure sensor or gauge 280, a mechanical specific energy (MSE) sensor 285, and a rotary RPM sensor 290. The hook load sensor 275 detects the load on the hook 135 as it suspends the top drive 140 and the drill string 155. The hook load detected via the hook load sensor 275 may be sent via electronic signal or other signal to the controller 210 via wired or wireless transmission. The pump pressure sensor or gauge 280 is configured to detect the pressure of the pump providing mud or otherwise powering the BHA from the surface. The pump pressure detected by the pump sensor pressure or gauge 280 may be sent via electronic signal or other signal to the controller 210 via wired or wireless transmission. The MSE sensor 285 is configured to detect the MSE representing the amount of energy required per unit volume of drilled rock. In some embodiments, the MSE is not directly sensed, but is calculated based on sensed data at the controller 210 or other controller about the apparatus 100. The rotary RPM sensor 290 is configured to detect the rotary RPM of the drill string 155. This may be measured at the top drive or elsewhere, such as at surface portion of the drill string 155. The RPM detected by the RPM sensor 290 may be sent via electronic signal or other signal to the controller 210 via wired or wireless transmission.

In an embodiment, the controller 210 calculates and outputs revolution value corrections based on a combination of the sensed rotary RPMs of the drill string 155, sensed torque of the drill string 155 at the interface with the top drive 140, and the desired oscillation revolution values. For example, upon receipt of torque data from the torque sensor 265 and rotary RPM data from the rotary RPM sensor 290, the controller 210 may calculate a revolution correction amount (either left or right revolution, or some combination of both) in order to provide additional control to the toolface orientation of the BHA 170. In an embodiment, the revolution correction amount output from the controller 210 may be provided in order to cause the top drive 140 to absorb substantially all of a torsional wave traveling along the drill string 155. In another embodiment, the revolution correction amount output from the controller 210 may be provided in order to cause the top drive 140 to absorb a determined percentage of a torsional wave traveling along the drill string 155, such that a remaining percentage of the torsional wave is reflected at the top drive 140 and propagated back down the drill string 155 to cause a determined amount of displacement at the BHA 170, thereby affecting toolface orientation in a controlled manner.

For example, the revolution correction amount may take into consideration a drill string impedance of the drill string 155 near the interface with the top drive 140. The drill string impedance may be determined according to known equations that involve different characteristics of the drill string 155, such as its inner and outer diameters, a shear modulus of the material of the drill string 155, and a density of the material of the drill string 155. The controller 210 may adjust the torque data received from the torque sensor 265 with the drill string impedance and adjust the RPM data received from the rotary RPM sensor 290 by a pre-determined factor. The controller 210 may also take these adjusted values and compare them to a desired rotational RPM of the drill string 155 (e.g., the RPM in right or left revolutions identified in one or more pre-stored default selectable oscillation profiles as described above). The controller 210 may then take these adjusted values, in embodiments as corrected by comparison to the desired rotational RPM, and process them to produce the revolution correction amount. In an embodiment, the controller 210 may process the adjusted values as a proportional-integral-derivative (PID) controller, or some subset thereof (e.g., proportional controller, proportional-integral controller, etc.).

The controller 210 may output the revolution correction amount as a correction signal and transmit it via electronic signal or other signal to the top drive 140 via wired or wireless transmission. The top drive 140 may then implement the correction signal by adjusting the RPMs, number of revolutions per direction, and/or torque applied via a motor of the top drive 140 to the drill string 155 during slide drilling operations, either directly or via the quill 145.

The top drive 140 may also include a controller 295 and/or other means for controlling the rotational position, speed and direction of the quill 145 or other drill string component coupled to the top drive 140 (such as the quill 145 shown in FIG. 1), shown in FIG. 2. Depending on the embodiment, the controller 295 may be integral with or may form a part of the controller 210. Moreover, as in the exemplary embodiment depicted in FIG. 2, the controller 295 of the top drive 140 may be configured to generate and transmit a signal to the controller 210. Consequently, the controller 295 of the top drive 170 may be configured to influence the number of rotations in an oscillation, the torque level threshold, or other oscillation regime target. It should be understood the number of rotations used at any point in the present disclosure may be a whole or fractional number.

The controller 210 may also be configured to receive detected information (i.e., measured or calculated) from the user-interface 205 and/or the BHA 170, and utilize such information to continuously, periodically, or otherwise operate to determine and identify an oscillation regime target, such as a target rotation parameter having improved effectiveness that either contributes to dampening torsional waves at the top drive 140, or manipulating (or causing) the torsional waves to effectuate a desired change in toolface orientation of the BHA 170. The controller 210 may be further configured to generate a control signal, such as via intelligent adaptive control, and provide the control signal to the top drive 140 to adjust and/or maintain the oscillation profile in order to most effectively perform a slide drilling operation.

The BHA 170 may include one or more sensors, typically a plurality of sensors, located and configured about the BHA 170 to detect parameters relating to the drilling environment, the BHA 170 condition and orientation, and other information. In the embodiment shown in FIG. 2, the BHA 170 includes an MWD casing pressure sensor 230 that is configured to detect an annular pressure value or range at or near the MWD portion of the BHA 170. The casing pressure data detected via the MWD casing pressure sensor 230 may be sent via electronic signal or other signal to the controller 210 via wired or wireless transmission. The BHA 170 may also include an MWD shock/vibration sensor 235 that is configured to detect shock and/or vibration in the MWD portion of the BHA 170. The shock/vibration data detected via the MWD shock/vibration sensor 235 may be sent via electronic signal or other signal to the controller 210 via wired or wireless transmission.

The BHA 170 may also include a mud motor ΔP sensor 240 that is configured to detect a pressure differential value or range across the mud motor of the BHA 170. The pressure differential data detected via the mud motor ΔP sensor 240 may be sent via electronic signal or other signal to the controller 210 via wired or wireless transmission. The mud motor ΔP may be alternatively or additionally calculated, detected, or otherwise determined at the surface, such as by calculating the difference between the surface standpipe pressure just off-bottom and pressure once the bit touches bottom and starts drilling and experiencing torque.

The BHA 170 may also include a magnetic toolface sensor 245 and a gravity toolface sensor 250 that are cooperatively configured to detect the current toolface orientation. The magnetic toolface sensor 245 may be or include a conventional or future-developed magnetic toolface sensor which detects toolface orientation relative to magnetic north. The gravity toolface sensor 250 may be or include a conventional or future-developed gravity toolface sensor which detects toolface orientation relative to the Earth's gravitational field. In an exemplary embodiment, the magnetic toolface sensor 245 may detect the current toolface when the end of the wellbore is less than about 7° from vertical, and the gravity toolface sensor 250 may detect the current toolface when the end of the wellbore is greater than about 7° from vertical. However, other toolface sensors may also be utilized within the scope of the present disclosure that may be more or less precise or have the same degree of precision, including non-magnetic toolface sensors and non-gravitational inclination sensors. In any case, the toolface orientation detected via the one or more toolface sensors (e.g., sensors 245 and/or 250) may be sent via electronic signal or other signal to the controller 210 via wired or wireless transmission.

The BHA 170 may also include an MWD torque sensor 255 that is configured to detect a value or range of values for torque applied to the bit by the motor(s) of the BHA 170. The torque data detected via the MWD torque sensor 255 may be sent via electronic signal or other signal to the controller 210 via wired or wireless transmission. The BHA 170 may also include an MWD weight-on-bit (WOB) sensor 260 that is configured to detect a value or range of values for WOB at or near the BHA 170. The WOB data detected via the MWD WOB sensor 260 may be sent via electronic signal or other signal to the controller 210 via wired or wireless transmission.

Figure 3:
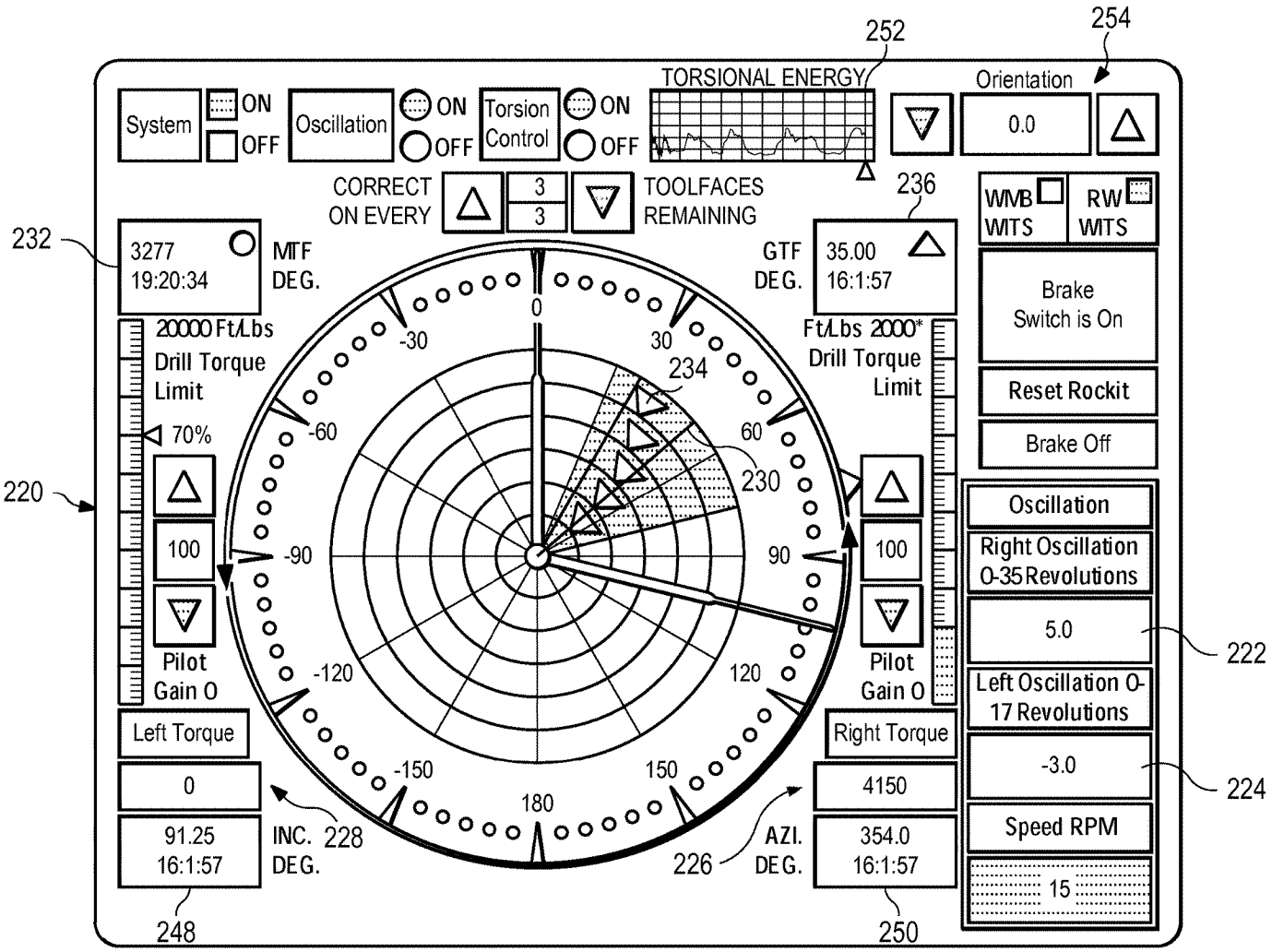
FIG. 3 is a diagram according to one or more aspects of the present disclosure.

FIG. 3 shows a portion of the display 220 that conveys information relating to the drilling process, the drilling rig apparatus 100, the top drive 140, and/or the BHA 170 to a user, such as a rig operator. As can be seen, the display 220 includes a right oscillation amount at 222, shown in this example as 5.0, and a left oscillation amount at 224, shown in this example as −3.0. These values represent the number of revolutions in each direction from a neutral center when oscillating during slide drilling operations. In some embodiments, the oscillation revolution values are selected to be values that provide a high level of oscillation so that a high percentage of the drill string 155 oscillates, to reduce axial (static) friction on the drill string 155 from the bore wall, while not disrupting the toolface orientation of the BHA 170.

In this example, the display 220 also conveys information relating to the torque settings that may be used as target torque settings to be used during an oscillation regime while slide drilling. Here, right torque and left torque may be entered in the regions identified by numerals 226 and 228 respectively. In some embodiments, the right and left torques are read only and not entered into the system. For example, the right and left torques may be selected as maximum threshold values beyond which the system has calculated the oscillations will reach the BHA 170 in an undesirable manner during slide drilling operations. Drilling may be most effective when the drilling system oscillates the drill string 155 sufficient to rotate the drill string 155 even very deep within the borehole, while permitting the drilling bit 175 to rotate only under the power of the motor. For example, right and left torque settings that only permit rotation of only the upper half of the drill string 155 will be less effective at reducing drag than settings that rotates nearly the entire drill string 155 while not affecting toolface orientation of the BHA 170. Therefore, the torque settings may be set so that the top drive 140 rotates substantially the entire drill string 155 without upsetting or rotating the BHA 170 in an undesirable manner. The threshold values may be set so as to avoid excessive oscillating revolutions, since such during a slide drilling operation might rotate the BHA 170 and undesirably change the toolface orientation (and hence drilling direction).

In addition to showing the oscillation rotational or revolution values and target torque, the display 220 also includes a dial or target shape having a plurality of concentric nested rings. In this embodiment, the magnetic-based tool face orientation data is represented by the line 230 and the data 232, and the gravity-based tool face orientation data is represented by symbols 234 and the data 236. The symbols and information may also or alternatively be distinguished from one another via color, size, flashing, flashing rate, shape, and/or other graphic means. In the exemplary display 220 shown in FIG. 3, the display 220 includes a historical representation of the tool face measurements, such that the most recent measurement and a plurality of immediately prior measurements are displayed. However, in other embodiments, the symbols may indicate only the most recent tool face and quill position measurements.

The display 220 may also include a textual and/or other type of indicator 248 displaying the current or most recent inclination of the remote end of the drill string 155. The display 220 may also include a textual and/or other type of indicator 250 displaying the current or most recent azimuth orientation of the remote end of the drill string 155.

The display 220 may also include one or more drill string vibration controls 252, 254 that visualize an amount of energy available to the system and assist the rig operator in using this amount of energy to either maintain the toolface orientation or control a change of the toolface orientation. In particular, this amount of energy may represent one or more torsional waves traveling along the drill string 155 during the slide drilling operation resulting from the left and right oscillations according to the oscillation revolution values set by the system to reduce drag along the drill string 155. In additional embodiments, this energy representing one or more torsional waves along the drill string 155 may be utilized, e.g., by the controller 210, to direct torsional wave energy to unstick sections of pipe along the drill string 155 or to cause the BHA 170 to rotate where it would otherwise not rotate.

A torsional energy map 252 may provide visualization of the amount of energy available to the system, e.g., in the form of a magnitude of the torsional waves determined by the controller 210 (e.g., in response to torque data provided from the torque sensor 265) plotted over time. In the embodiment shown in FIG. 3, the torsional energy map 252 displays the torsional energy over a fixed time window extending back from the present instant (or most recent measurement). The window may extend back a range of seconds, minutes, hours, or some other increment as will be recognized. In an embodiment, the torsional energy map 252 may be rescaled as desired by the rig operator.

The drill string vibration control 254 may include a toolface orientation change request indicator as well as buttons to toggle the orientation change request up or down. For example, the rig operator may utilize other aspects of the display 220, such as the dial (and graphics thereon) and/or the indicator 248 that displays the most current/recent inclination/azimuth orientation of the remote end of the drill string 155. Based on the information obtained regarding the toolface orientation and the torsional energy displayed, the rig operator may determine whether a change in toolface orientation is desired or not during the slide drilling procedure.

If a change in toolface orientation is not desired, the rig operator may leave the setting at 0.0, indicating no change, which results in the controller 210 instructing the top drive 240 to absorb substantially all of the torsional wave(s) from the drill string 155 so that they are not reflected and propagated along the drill string 155 to potentially (and undesirably in this situation) reach and affect the BHA 170. For example, the controller 210 may receive or retrieve the current torsional wave magnitude as reported via the torsional energy map 252, the current RPMs as detected by and reported from the rotary RPM sensor 290, and a drill string impedance of the drill string 155 near the interface with the top drive 140 (e.g., as obtained using known equations and inputs either stored with the controller 210 or received via the input 215). With this information, the controller 210 determines an adjustment value to one or more of the set revolution amount (e.g., for one or both right and left oscillations) and the rotary RPM value. The adjustment value thus determined by the controller 210 is one that, when implemented by the top drive 140, will cause the top drive 140 to absorb substantially all of the torsional wave currently propagating along the top of the drill string 155, so that substantially none of the energy is reflected back to propagate along the drill string 155 back toward the BHA 170. The controller 210 transmits the adjustment value to the top drive 140 for implementation.

If a change in toolface orientation is desired during the slide drilling procedure, the rig operator may use the toggles up or down to affect one or more of the inclination and azimuth of the BHA 170 so as to change the toolface orientation. Although the drill string vibration control 254 is illustrated with one toggle pair, it will be recognized that more pairs may be included, for example combining with the indicator 248 to toggle both inclination and azimuth settings for the BHA 170. Toggling the drill string vibration control 254 (up or down, for example, to a non-zero value) results in the controller 210 determining how much of the current torsional wave energy existing along the drill string 155 should be absorbed in order to leave some existing on the drill string 155 to cause a controlled change in the toolface orientation at the BHA 170 in response to the toggled value. In some embodiments, the desired change is automatically input by the controller after being calculated so that the BHA can follow or make corrections to follow a pre-established drill plan. In other instances, the desired change is output to an operator for manual entry.

For example, the controller 210 may receive the desired change entered by the rig operator via the drill string vibration control 254. The controller 210 may also receive or retrieve the current torsional wave magnitude as reported via the torsional energy map 252, the current RPMs as detected by and reported from the rotary RPM sensor 290, and a drill string impedance of the drill string 155 near the interface with the top drive 140 (e.g., as obtained using known equations and inputs either stored with the controller 210 or received via the input 215). With this information, the controller 210 determines an adjustment value to one or more of the set revolution amount (e.g., for one or both right and left oscillations) and the rotary RPM value. The adjustment value thus determined by the controller 210 is one that, when implemented by the top drive 140, will cause the top drive 140 to absorb a portion of the torsional wave currently propagating along the top of the drill string 155. The controller 210 determines, based on the inputs, what amount of the torsional wave should be absorbed so that a fraction of that torsional wave is reflected at the top drive 140 back to propagate along the drill string 155 toward the BHA 170, with the objective that some portion of that reflected wave will provide sufficient force to cause the BHA 170 to shift a fixed amount in order to change the toolface orientation in a controlled manner. The controller 210 transmits the adjustment value to the top drive 140 for implementation.

The amount of the desired change entered via the drill string vibration control 254 may be stored by the controller 210 as a delta value, or alternatively may be combined with the current observed inclination/azimuth values and then stored. The controller 210 may then compare updated inclination/azimuth measurements as they are received against the stored, desired value(s). Based on the results of the comparison, the controller 210 may then repeat the above process by computing what fraction of the torsional wave now sensed at the interface of the drill string 155 and the top drive 140 should be reflected back along the drill string 155 to continue assisting the BHA 170 in shifting to affect the toolface orientation in a controller fashion.

This may be repeated as necessary until the measured inclination/azimuth of the BHA 170 corresponds to the desired inclination/azimuth within a range set for tolerance. This may occur as a real-time process, e.g., the controller 210 may calculate the adjustment value(s) necessary to effectuate the instruction received from the drill string vibration control 254 (either a change value entered or left at 0.0) as the data is received and processed at the controller 210 in real-time or near real-time.

Additional selectable buttons, icons, and information may be presented to the user as indicated in the exemplary display 220. Additional details that may be included or sued include those disclosed in U.S. Pat. No. 8,528,663 to Boone, which is incorporated herein by express reference thereto.

Figure 4:
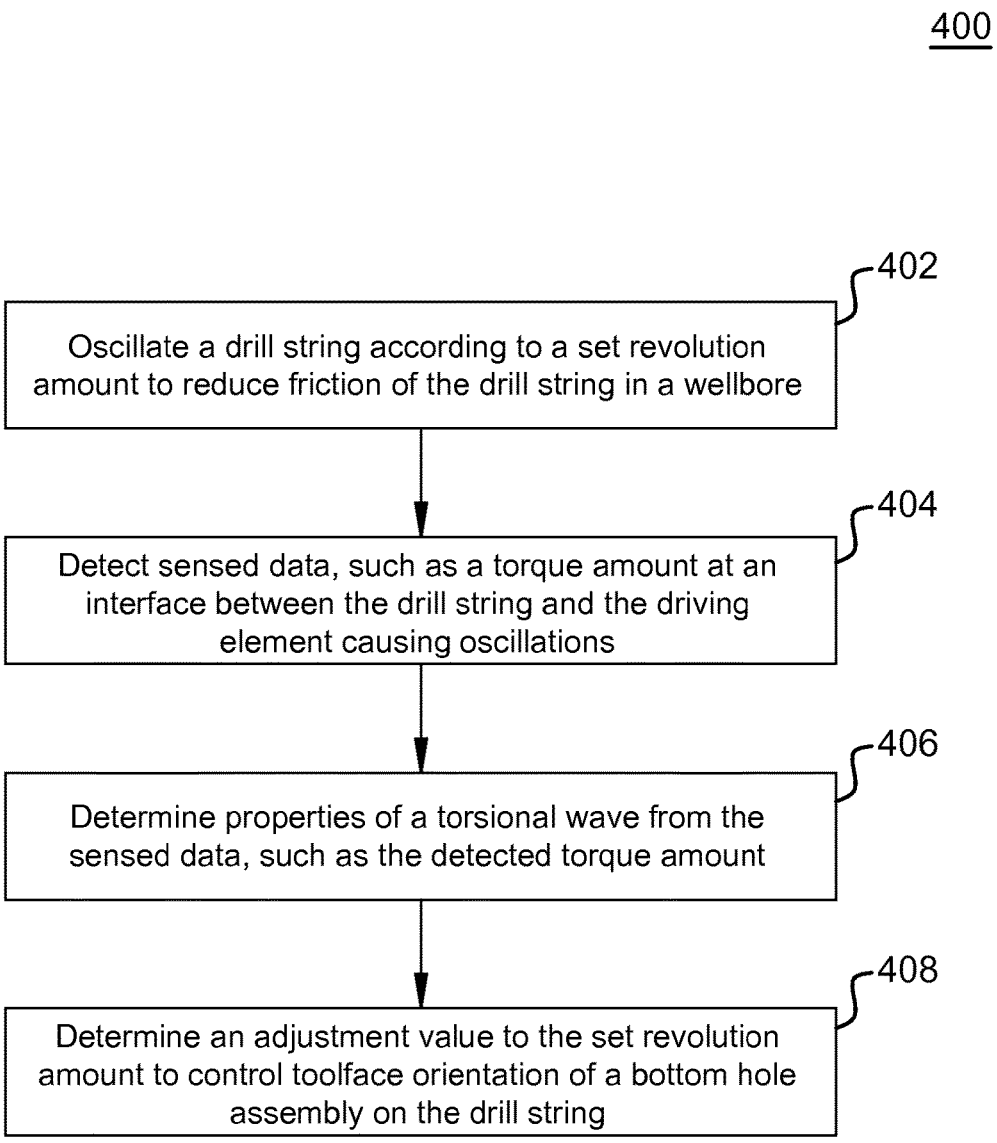
FIG. 4 is a flow-chart diagram of a method for controlling toolface orientation according to one or more aspects of the present disclosure.

FIG. 4 is a flow chart showing an exemplary method 400 of controlling toolface orientation according to one or more aspects of the present disclosure. The method 400 may be performed, for example, by the controller 210 described above with respect to FIGS. 2-3. The method 400 occurs during a slide drilling operation.

At step 402, the controller 210 instructs the top drive 140 to oscillate the drill string 155 according to a set revolution amount. The controller 210 may have set the revolution amount previously according to a prior slide drilling operation, e.g., the revolution amount used at the end of the prior operation, may be estimated by the controller 210 based on information input to the controller 210 (e.g., from one or more sensors), or be received as input from a rig operator, for example as input by the input mechanism 215. The oscillation is useful to reduce the amount of friction between the drill string 155 and the wellbore, for example by converting static friction to dynamic friction from the oscillating movement.

At step 404, the controller 210 receives torque data corresponding to a detected torque amount from the torque sensor 265 at or near the top drive 140, e.g., at an interface between the top drive 140 and the drill string 155.

At step 406, the controller 210 determines properties of a torsional wave based on sensed data, such as the detected torque amount. For example, the controller 210 determines one or more properties of the torsional wave, e.g., a magnitude, by using one or more known equations and the torque and drill string 155 characteristics as inputs. Additional details relating to exemplary known equations may be found in PCT/EP2014/055490, which is expressly incorporated herein by reference in its entirety.

At step 408, the controller 210 determines an adjustment value for the set revolution amount of the drill string 155 that will control the toolface orientation of the BHA 170 for a desired result. For example, the controller 210 may calculate an adjustment value by determining whether the current set revolution amount, and/or the speed at which it is applied, will mitigate/absorb the torsional wave according to an input parameter. For example, the rig operator may have in the input section of the drill string vibration control 254 a value of 0.0, representing that it is desired for the top drive 140 to absorb substantially all of the torsional wave. In another example, the rig operator may have entered a desired change amount in any one of azimuth or inclination (or both), which may translate into the controller 210 instructing the top drive 140 to absorb some fraction of the torsional wave. Based on the indicated action (e.g., either maintaining toolface orientation or changing a desired amount), the controller 210 calculates the set revolution amount/speed of the revolution necessary to achieve the desired level of absorption. Some embodiments automatically enter the adjustment according to a well plan, a deviation from the well plan, or other factor.

The method 400 may continue according to the above steps (and others not shown) during slide drilling operations. According to embodiments of the method 400, the controller 210 causes the system to manipulate an amplitude of the torsional wave along the drill string 155 at a given point in time, e.g., real-time or near real-time, to control toolface orientation during the slide drilling operation to maintain a desired orientation or to obtain a desired orientation.

Figure 5:
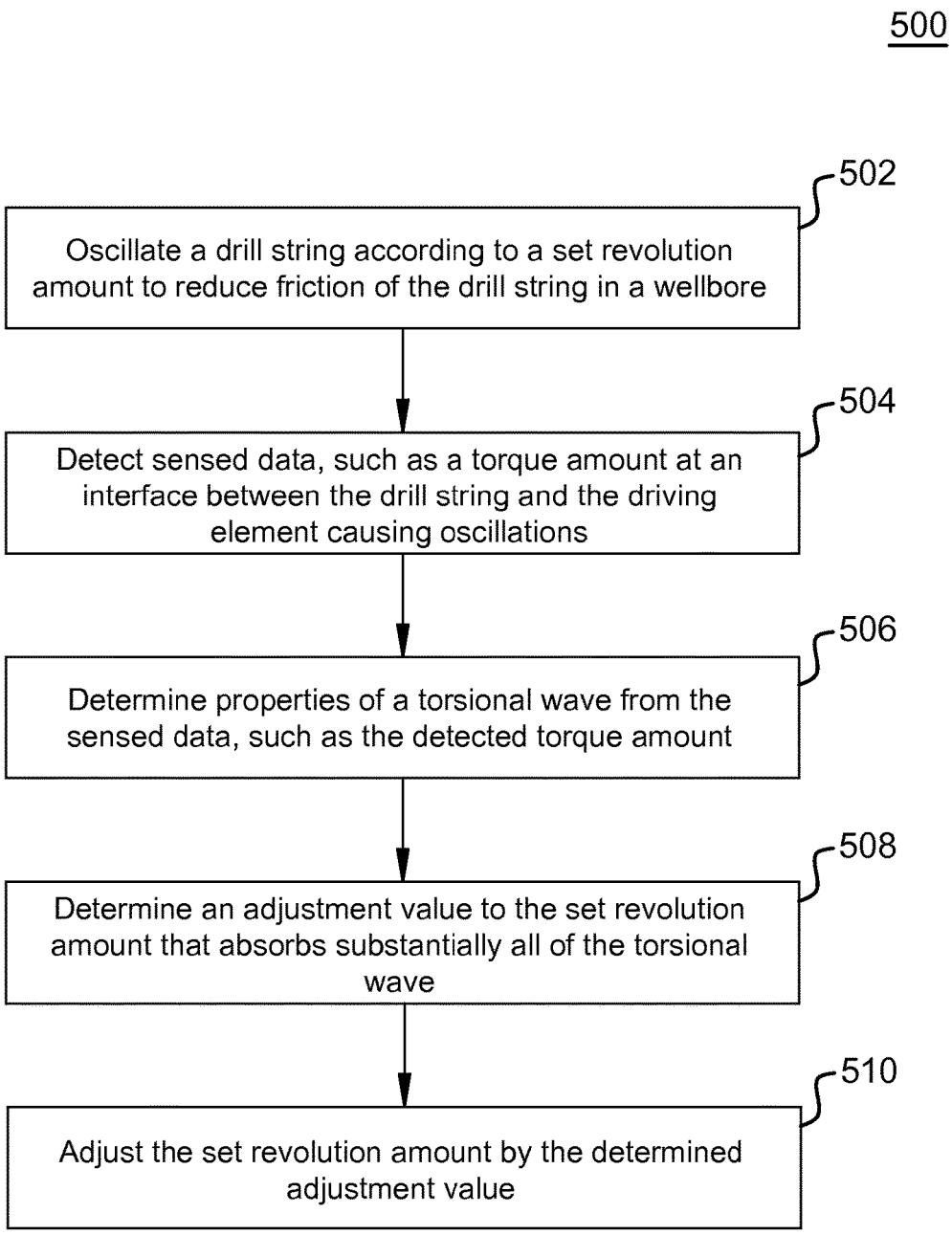
FIG. 5 is a flow diagram of a method for maintaining toolface orientation according to one or more aspects of the present disclosure.

FIG. 5 is a flow diagram of a method 500 for maintaining toolface orientation according to one or more aspects of the present disclosure. The method 500 may be performed, for example, by the controller 210 described above with respect to FIGS. 2-3. The method 500 occurs during a slide drilling operation.

At step 502, the controller 210 instructs the top drive 140 to oscillate the drill string 155 according to a set revolution amount in order to reduce the amount of friction between the drill string 155 and the wellbore, for example as discussed above with respect to step 402 of method 400.

At step 504, the controller 210 receives torque data corresponding to a detected torque amount from the torque sensor 265 at or near the top drive 140, e.g., at an interface between the top drive 140 and the drill string 155.

At step 506, the controller 210 determines properties of a torsional wave based on the detected or sensed properties of the wave or the drill string, such as a torque amount. For example, the controller 210 determines properties of the torsional wave amount, e.g., a magnitude, by using one or more known equations and the torque and drill string 155 characteristics as inputs.

At step 508, the controller 210 determines an adjustment value for the set revolution amount of the drill string 155 that will cause the top drive 140 to absorb substantially all of the torsional wave, and thereby maintain the toolface orientation of the BHA 170 in its current orientation. For example, the controller 210 may calculate an adjustment value by determining whether the current set revolution amount, and/or the speed at which it is applied, will substantially absorb the torsional wave according to an input parameter from the rig operator. For example, the rig operator may have in the input section of the drill string vibration control 254 a value of 0.0, representing that it is desired for the top drive 140 to absorb substantially all of the torsional wave. Based on the input parameter indicating that the toolface orientation should be maintained, the controller 210 calculates the set revolution amount/speed of the revolution necessary to achieve the desired level of absorption, and determines the resulting adjustment value to achieve that revolution amount and/or speed.

At step 510, the controller 210 transmits the determined adjustment value to the top drive 140. The top drive 140 adjusts the set revolution amount and/or speed currently applied to the drill string 155 according to the data contained in the adjustment value signal, resulting in a real-time or near-real time response to the torsional wave determined to be at the drill string 155 near the interface with the top drive 140.

Figure 6:
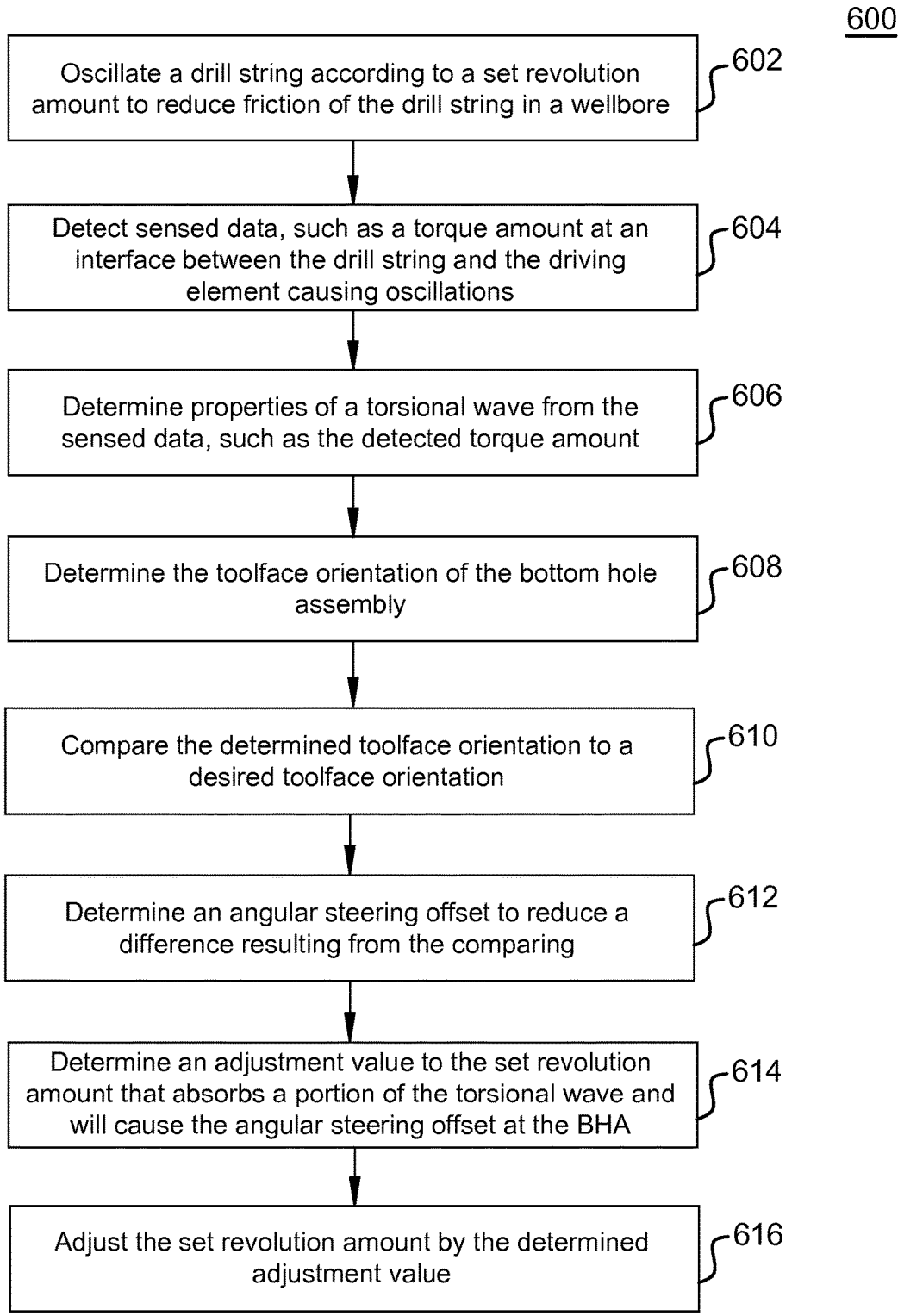
FIG. 6 is a flow diagram of a method for changing toolface orientation according to one or more aspects of the present disclosure.

FIG. 6 is a flow diagram of a method 600 for changing toolface orientation according to one or more aspects of the present disclosure. The method 600 may be performed, for example, by the controller 210 described above with respect to FIGS. 2-3. The method 600 occurs during a slide drilling operation.

At step 602, the controller 210 instructs the top drive 140 to oscillate the drill string 155 according to a set revolution amount in order to reduce the amount of friction between the drill string 155 and the wellbore, for example as discussed above with respect to step 402 of method 400.

At step 604, the controller 210 receives sensed data, such as torque data, corresponding to a detected torque amount from the torque sensor 265 at or near the top drive 140, e.g., at an interface between the top drive 140 and the drill string 155.

At step 606, the controller 210 determines properties of a torsional wave based on the sensed data, such as detected torque amount. For example, the controller 210 determines one or more properties of the torsional wave, e.g., a magnitude, by using one or more known equations and the sensed data and drill string 155 characteristics as inputs.

At step 608, the controller 210 determines a toolface orientation of the BHA 170. The controller 210 may determine the orientation based on the same or similar factors as those used to provide the azimuth and inclination information to the indicator 248 for displaying the current or most recent inclination of the remote end of the drill string 155. This information may be obtained, for example, from one or more of the magnetic toolface sensor 245 and the gravity toolface sensor or from other measurements or calculations.

At step 610, the controller 210 compares the determined toolface orientation with a desired toolface orientation, and produces a difference value from the comparison. The desired toolface orientation may be a value previously stored in a memory associated with the controller 210, such as memory 211 described above. The desired toolface orientation may be provided from a set of instructions previously stored in the memory 211, e.g., according to a pre-specified drilling path planned out in advance of slide drilling operations. Alternatively, the desired toolface orientation may be obtained at time of input from a rig operator from the drill string vibration control 254, such as from the rig operator toggling one or more values up or down from a previous desired orientation. The desired toolface orientation may also be obtained from the memory 211, e.g., from a value input via the drill string vibration control 254 at a previous point in time, which may occur at times where the BHA 170 is still moving to reach the desired orientation for the toolface based on a previously-input change request.

At step 612, the controller 210 determines an angular steering offset for the BHA 170 that will reduce the difference value obtained at step 610. In an embodiment, the controller 210 calculates the magnitude of a torsional wave existing at the drill string 155 that would be necessary to propagate a sufficient distance down the drill string 155 in order to cause the BHA 170 to move a desired amount in a desired direction. In other words, the controller 210 determines what fraction of the torsional wave determined at step 606 should be absorbed by the top drive 140, and thereby what fraction reflected for use in controlling the toolface orientation.

At step 614, the controller 210 determines an adjustment value to the set revolution amount and/or RPM that causes the top drive 140 to absorb the specified fraction of the torsional wave, based on the determined angular steering offset at step 612. For example, the controller 210 may determine an adjustment value to one or more of the set revolution amount (e.g., for one or both right and left oscillations) and the rotary RPM value.

At step 616, the controller 210 changes the set revolution amount by the adjustment value. The controller 210 transmits the adjustment value and/or the adjusted set revolution amount to the top drive 140 for implementation. In response, the top drive 140 modifies its set revolution amount and/or RPM for the revolutions and absorbs a fraction of the torsional wave at the top of the drill string 155. The remaining fraction of the torsional wave is reflected back down the drill string 155 from the top drive 140 and reaches the BHA 170 at a magnitude capable of assisting the BHA 170 to shift in position toward the desired toolface orientation from the detected toolface orientation.

By using the systems and method described herein, a rig operator can more easily operate the rig during slide drilling at a maximum efficiency to minimize the effects of frictional drag on the drill string during slide drilling while utilizing information regarding torsional waves along the drill string to improve control of the toolface orientation. This can increase drilling efficiency which saves time and reduces drilling costs.

In view of all of the above and the figures, one of ordinary skill in the art will readily recognize that the present disclosure introduces a method for controlling toolface orientation, comprising: oscillating a drill string coupled to a top drive an oscillation revolution amount to reduce friction of the drill string in a wellbore during a slide drilling procedure; detecting a torsional wave traveling along the drill string produced in response to the oscillating the drill string during the slide drilling procedure; and modifying the oscillation revolution amount in response to the detected torsional wave to control the toolface orientation of a bottom hole assembly on the drill string during the slide drilling procedure.

In an aspect, the method includes adjusting the oscillation revolution amount to absorb substantially all of the detected torsional wave to maintain the toolface orientation of the bottom hole assembly. In an aspect, the adjusting further comprises: calculating a maximum threshold torsional wave magnitude beyond which the torsional wave would cause an undesirable change in the toolface orientation; determining a target oscillation revolution amount that would result in the calculated maximum threshold torsional wave magnitude along the drill string; and adjusting the oscillation revolution amount to or below the target oscillation revolution amount. In an aspect, the modifying further comprises: determining the toolface orientation of the bottom hole assembly; and comparing the determined toolface orientation to a desired toolface orientation. In an aspect, the method further includes calculating a difference between the determined toolface orientation and the desired toolface orientation; and calculating a desired angular steering offset that will reduce the calculated difference. In an aspect, the method further includes adjusting the oscillation revolution amount to dampen at least a portion of the detected torsional wave and allow the desired angular steering offset to reach the bottom hole assembly to control a change of the toolface orientation from the determined toolface orientation to the desired toolface orientation. In another aspect, the detecting further comprises: detecting torque by a sensor disposed at an interface between the top drive and the drill string; and determining the torsional wave based on the detected torque.

The present disclosure also introduces a drilling apparatus comprising a top drive controllable to rotate a drill string in a first rotational direction during a rotary drilling operation and to oscillate the drill string in the first rotational direction and an opposite second rotational directional during a slide drilling procedure according to a determined oscillation revolution amount to reduce friction of the drill string in a downhole bore of a wellbore; a sensor configured to detect a torsional wave traveling along the drill string produced in response to the oscillation of the drill string during the slide drilling procedure; and a controller configured to receive information representing the torsional wave from the sensor and, based on the received information from the sensor, modify the determined oscillation revolution amount to control toolface orientation of a bottom hole assembly on the drill string during the slide drilling.

In an aspect, the sensor comprises a torque sensor configured to detect torque, and the controller is further configured to determine properties of the torsional wave based on the detected torque. In an aspect, the controller is further configured to modify the oscillation revolution amount to absorb substantially all of the detected torsional wave to maintain the toolface orientation of the bottom hole assembly. In an aspect, the controller is further configured to: calculate a maximum threshold torsional wave magnitude beyond which the torsional wave would cause an undesirable change in the toolface orientation; determine a target oscillation revolution amount that would result in the calculated maximum threshold torsional wave magnitude along the drill string; and adjust the oscillating of the drill string to the target oscillation revolution amount. In an aspect, the controller is further configured to: determine the toolface orientation of the bottom hole assembly; and compare the determined toolface orientation to a desired toolface orientation. In an aspect, the controller is further configured to: calculate a difference between the determined toolface orientation and the desired toolface orientation; and calculate a desired angular steering offset that will reduce the calculated difference. In an aspect, the controller is further configured to: adjust the oscillation revolution amount to dampen at least a portion of the detected torsional wave and allow the desired angular steering offset to reach the bottom hole assembly to control a change of the toolface orientation from the determined toolface orientation to the desired toolface orientation.

The present disclosure also introduces a method for controlling toolface orientation, comprising: determining a first oscillation revolution amount determined based on one or more characterizations of a drill string in a wellbore during a slide drilling procedure; oscillating the drill string the first oscillation revolution amount to reduce friction of the drill string in the wellbore during the slide drilling procedure; detecting a torsional wave traveling along the drill string produced in response to the oscillating the drill string during the slide drilling procedure; and adjusting the first oscillation revolution amount based on the detected torsional wave to a second oscillation revolution amount different from the first oscillation revolution amount in a manner that controls toolface orientation of a bottom hole assembly on the drill string during the slide drilling procedure.

In an aspect, the method includes receiving a plurality of data regarding one or more conditions of the drill string and the wellbore from a corresponding plurality of sensors; and characterizing the drill string based on the received plurality of data, wherein the determining the first oscillation revolution amount is based on the characterizing. In an aspect, the adjusting further comprises: setting the second oscillation revolution amount to allow a top drive assembly coupled to the drill string to absorb substantially all of the detected torsional wave to maintain the toolface orientation of the bottom hole assembly. In an aspect, the adjusting further comprises: determining the toolface orientation of the bottom hole assembly; and comparing the determined toolface orientation to a desired toolface orientation. In an aspect, the method further includes calculating a difference between the determined toolface orientation and the desired toolface orientation; and calculating a desired angular steering offset that will reduce the calculated difference. In an aspect, the method further includes setting the second oscillation revolution amount to dampen at least a portion of the detected torsional wave and allow the desired angular steering offset to reach the bottom hole assembly to control a change of the toolface orientation from the determined toolface orientation to the desired toolface orientation.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112, paragraph 6 for any limitations of any of the claims herein, except for those in which the claim expressly uses the word "means" together with an associated function.

What is claimed is:

1. A method for controlling toolface orientation, comprising:

oscillating a drill string coupled to a top drive an oscillation revolution amount to reduce friction of the drill string in a wellbore during a slide drilling procedure;

detecting a torsional wave traveling along the drill string produced in response to the oscillating the drill string during the slide drilling procedure; and modifying the oscillation revolution amount in response to the detected torsional wave to dampen at least a portion of the detected torsional wave to maintain the toolface orientation of a bottom hole assembly on the drill string during the slide drilling procedure.

2. The method of claim 1, wherein the modifying further comprises:

adjusting the oscillation revolution amount to absorb substantially all of the detected torsional wave to maintain the toolface orientation of the bottom hole assembly.

3. The method of claim 2, wherein the adjusting further comprises:

calculating a maximum threshold torsional wave magnitude beyond which the torsional wave would cause an undesirable change in the toolface orientation;

determining a target oscillation revolution amount that would result in the calculated maximum threshold torsional wave magnitude along the drill string; and adjusting the oscillation revolution amount to or below the target oscillation revolution amount.

4. The method of claim 1, wherein the modifying further comprises:

determining the toolface orientation of the bottom hole assembly; and comparing the determined toolface orientation to a desired toolface orientation.

5. The method of claim 4, further comprising:

calculating a difference between the determined toolface orientation and the desired toolface orientation; and calculating a desired angular steering offset that will reduce the calculated difference.

6. The method of claim 5, further comprising:

adjusting the oscillation revolution amount to allow the desired angular steering offset to reach the bottom hole assembly to control a change of the toolface orientation from the determined toolface orientation to the desired toolface orientation.

7. The method of claim 1, wherein the detecting further comprises:

detecting torque by a sensor disposed at an interface between the top drive and the drill string; and determining the torsional wave based on the detected torque.

8. A drilling apparatus, comprising:

a top drive controllable to rotate a drill string in a first rotational direction during a rotary drilling operation and to oscillate the drill string in the first rotational direction and an opposite second rotational directional during a slide drilling procedure according to a determined oscillation revolution amount to reduce friction of the drill string in a downhole bore of a wellbore;

a sensor configured to detect a torsional wave traveling along the drill string produced in response to the oscillation of the drill string during the slide drilling procedure; and a controller configured to receive information representing the torsional wave from the sensor and, based on the received information from the sensor, modify the determined oscillation revolution amount to dampen at least a portion of the detected torsional wave to maintain a toolface orientation of a bottom hole assembly on the drill string during the slide drilling.

9. The drilling apparatus of claim 8, wherein:

the sensor comprises a torque sensor configured to detect torque, and the controller is further configured to determine properties of the torsional wave based on the detected torque.

10. The drilling apparatus of claim 8, wherein the controller is further configured to modify the oscillation revolution amount to absorb substantially all of the detected torsional wave to maintain the toolface orientation of the bottom hole assembly.

11. The drilling apparatus of claim 10, wherein the controller is further configured to:

calculate a maximum threshold torsional wave magnitude beyond which the torsional wave would cause an undesirable change in the toolface orientation;

determine a target oscillation revolution amount that would result in the calculated maximum threshold torsional wave magnitude along the drill string; and adjust the oscillating of the drill string to the target oscillation revolution amount.

12. The drilling apparatus of claim 8, wherein the controller is further configured to:

determine the toolface orientation of the bottom hole assembly; and compare the determined toolface orientation to a desired toolface orientation.

13. The drilling apparatus of claim 12, wherein the controller is further configured to:

calculate a difference between the determined toolface orientation and the desired toolface orientation; and calculate a desired angular steering offset that will reduce the calculated difference.

14. The drilling apparatus of claim 8, wherein the controller is further configured to:

adjust the oscillation revolution amount to allow the desired angular steering offset to reach the bottom hole assembly to control a change of the toolface orientation from the determined toolface orientation to the desired toolface orientation.

15. A method for controlling toolface orientation, comprising:

determining a first oscillation revolution amount determined based on one or more characterizations of a drill string in a wellbore during a slide drilling procedure;

oscillating the drill string the first oscillation revolution amount to reduce friction of the drill string in the wellbore during the slide drilling procedure;

detecting a torsional wave traveling along the drill string produced in response to the oscillating the drill string during the slide drilling procedure; and adjusting the first oscillation revolution amount based on the detected torsional wave to a second oscillation revolution amount different from the first oscillation revolution amount to dampen at least a portion of the detected torsional wave to maintain the toolface orientation of a bottom hole assembly on the drill string during the slide drilling procedure.

16. The method of claim 15, further comprising:

receiving a plurality of data regarding one or more conditions of the drill string and the wellbore from a corresponding plurality of sensors; and characterizing the drill string based on the received plurality of data, wherein the determining the first oscillation revolution amount is based on the characterizing.

17. The method of claim 15, wherein setting the second oscillation revolution amount allows a top drive assembly coupled to the drill string to absorb substantially all of the detected torsional wave to maintain the toolface orientation of the bottom hole assembly.

18. The method of claim 15, wherein the adjusting further comprises:

determining the toolface orientation of the bottom hole assembly; and comparing the determined toolface orientation to a desired toolface orientation.

19. The method of claim 18, further comprising:

calculating a difference between the determined toolface orientation and the desired toolface orientation; and calculating a desired angular steering offset that will reduce the calculated difference.

20. The method of claim 19, further comprising:

setting the second oscillation revolution amount to allow the desired angular steering offset to reach the bottom hole assembly to control a change of the toolface orientation from the determined toolface orientation to the desired toolface orientation.

* * * * *